US007322908B2

(12) United States Patent
DiGiacomo

(10) Patent No.: US 7,322,908 B2
(45) Date of Patent: Jan. 29, 2008

(54) EXERCISE DEVICE

(75) Inventor: Ronald DiGiacomo, Holtsville, NY (US)

(73) Assignee: Torcore Holdings LLC, Hauppauge, NY (US)

( * ) Notice: Subject to any disclaimer, the term of this patent is extended or adjusted under 35 U.S.C. 154(b) by 0 days.

(21) Appl. No.: 11/197,664

(22) Filed: Aug. 4, 2005

(65) Prior Publication Data

US 2007/0032355 A1 Feb. 8, 2007

(51) Int. Cl.
*A63B 21/02* (2006.01)

(52) U.S. Cl. ..... 482/121; 482/124; 482/109

(58) Field of Classification Search ..... 482/121, 482/124, 109, 122–130; 473/212, 217
See application file for complete search history.

(56) References Cited

U.S. PATENT DOCUMENTS

| | | | | |
|---|---|---|---|---|
| 3,820,781 | A * | 6/1974 | Kane | 482/93 |
| 4,758,000 | A | 7/1988 | Cox | |
| 4,770,414 | A | 9/1988 | Fredrickson et al. | |
| 5,024,443 | A | 6/1991 | Bellagamba | |
| 5,048,836 | A | 9/1991 | Bellagamba | |
| 5,096,199 | A * | 3/1992 | Wyatt et al. | 473/212 |
| 5,190,512 | A * | 3/1993 | Curran | 482/124 |
| 5,487,714 | A | 1/1996 | Ferrari | |
| 5,529,306 | A * | 6/1996 | Staats et al. | 473/208 |
| 6,013,013 | A | 1/2000 | Wolf | |
| 6,113,522 | A | 9/2000 | Fontenot et al. | |
| 6,120,424 | A * | 9/2000 | Arline | 482/121 |
| 6,293,893 | B1 | 9/2001 | Truchelut | |
| 6,386,988 | B1 | 5/2002 | Shearer et al. | |
| 6,805,641 | B2 | 10/2004 | Pope | |
| 6,872,174 | B2 | 3/2005 | Benach | |
| 2005/0085354 | A1 | 4/2005 | Rice | |

* cited by examiner

*Primary Examiner*—Lori Amerson
(74) *Attorney, Agent, or Firm*—Keusey, Tutunjian & Bitetto, P.C.

(57) ABSTRACT

An exercise apparatus is provided, either in assembled or kit form, particularly for emulating and improving a golf swing. The apparatus includes an elongate bar having hand grips each disposed at opposite ends thereon, and a neck support disposed at a substantially central portion of the bar. The bar includes at least one forearm plate permanently or removably attached on an underside near either end of the bar. At least one resistance band is provided, although a plurality is preferably provided in the kit form, for removable attachment of the forearm plate with a foot brace. Such removable attachment advantageously facilitates changing of resistance bands to different levels of resistance/length, switching of the foot brace, as well as, e.g., in an embodiment including two forearm plates, switching between attachment of the resistance band to either forearm plate. Accordingly, a user may work both the right or left side muscle groups.

14 Claims, 3 Drawing Sheets

EXERCISE DEVICE

TECHNICAL FIELD OF THE INVENTION

The present invention generally relates to exercise devices, and, more particularly, to an isotonic exercise device for providing resistance for a user to improve strength, flexibility and rhythm during, e.g., a golf swing.

BACKGROUND OF THE INVENTION

There exists today a wide range of exercise devices for providing resistance training of various muscles. While many exercise machines may help develop overall physical fitness in general, it is often a goal of many exercisers to use exercise machines to improve strength and fitness for a particular sport.

Golf, one of the most popular sports today, enjoys its popularity in part to its appeal to a wide range of people in different age groups and of varying levels of fitness. However, many golfers have found that improving musculoskeletal strength, flexibility and endurance is beneficial in improving consistency and accuracy as well as distance when hitting a golf ball. For golfers, exercises which specifically target the muscles utilized during a golf swing are of particular benefit.

Existing golf-related training devices are often targeted towards improving only certain skills, such as eye-hand coordination, improving grip, or restraining the golf swing to a correct swing path. A device which offers some resistance during an exercise emulating a golf swing is disclosed in U.S. Pat. No. 6,013,013, however, the resistance provided is limited to the duration of the downswing; no resistance is provided during the backswing. Further, the device is bulky and requires a support base which must be wedged under a closed door to secure same during use.

Accordingly, a need exists for a system and method for efficiently and effectively exercising the pertinent muscles used, e.g., to increase power to a golfer's swing, in a convenient manner that overcomes the limitations of the prior art.

SUMMARY OF THE INVENTION

The present invention comprises an exercise/golf/rhythm training aid, that, while being targeted towards the golfer, is useful for the general fitness consumer. For example, the present invention provides an effective and efficient exercise apparatus particularly directed towards strengthening muscle groups for, e.g., the purpose of improving a golf swing. That is, according to one embodiment, the present invention is designed to mimic the golf swing and work the "core" muscle groups (e.g., the internal and external obliques, rectus abdominus and lower portions of the latissimus dorsi muscles) of the user.

In one aspect, the present invention provides an exercise apparatus comprising an elongate bar having a first end and a second end, and at least one forearm plate attached to one of the first and second bar ends, the forearm plate including an attachment point. A foot brace is provided having at least one attachment point and a resistance band is provided having a first end attached to the forearm plate attachment point and a second end attached to the at least one foot brace attachment point.

In another aspect, the present invention provides an exercise apparatus kit comprising an elongate bar having a first end and a second end, at least one forearm plate, the forearm plate including an attachment point, at least one resistance band having a first end and a second end, each end including attachment points, and a foot brace having at least one attachment point.

In yet another aspect, an exercise apparatus is provided comprising an elongate bar having a first end, a second end, two angled portions, and a pair of handgrips disposed at each end of the bar. A neck support is provided disposed at a substantially central portion of the bar, wherein the angled portions hold the neck support offset from the bar. At least one forearm plate is provided having an edge attached to one of the first and second bar ends, the forearm plate including an attachment point at a substantially distal portion thereof. A foot brace is provided comprising a foot platform and a foot piece, the brace having at least one attachment point, and a resistance band is provided having a first end releasably attached to the forearm plate attachment point and a second end releasably attached to the at least one foot brace attachment point.

These, and other aspects, features and advantages of the present invention will be described or become apparent from the following detailed description of the preferred embodiments, which is to be read in connection with the accompanying drawings.

BRIEF DESCRIPTION OF THE DRAWINGS

In the drawings, wherein like reference numerals denote similar elements throughout the views.

It should be understood that the drawings are for purposes of illustrating the concepts of the invention and are not necessarily the only possible configurations for illustrating the invention.

DETAILED DESCRIPTION OF THE INVENTION

Figure 1:
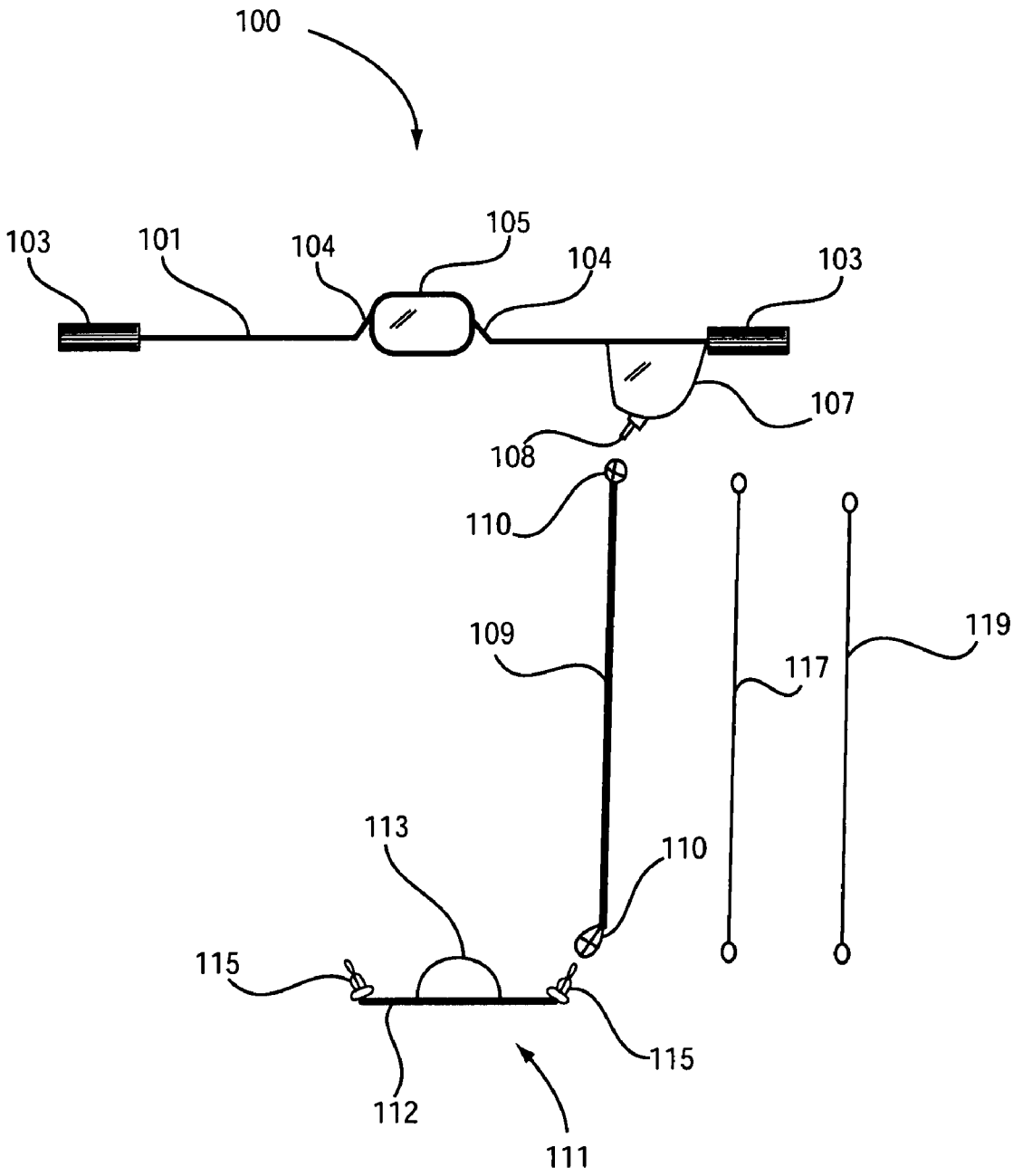
FIG. 1 is an exemplary front view of the various elements of an exercise apparatus according to an aspect of the present invention.
Figure 2:
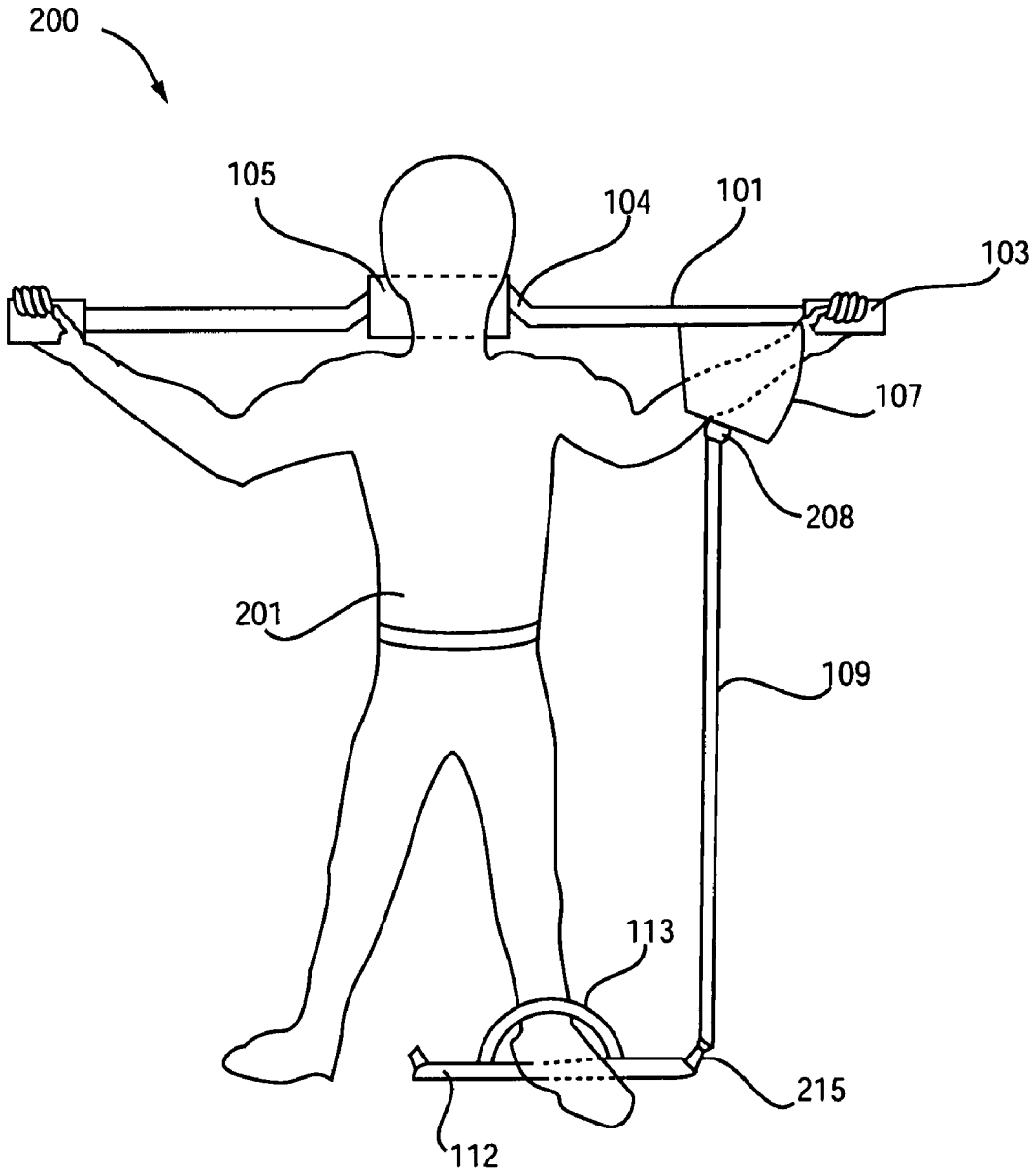
FIG. 2 is an exemplary front view of an individual operating an assembled exercise apparatus according to an aspect of the present invention.

Referring now to the Figures, FIG. 1 is an exemplary front view of the various elements of an exercise apparatus 100 according to an aspect of the present invention and FIG. 2 is an exemplary front view of an individual operating an assembled exercise apparatus 200. The exercise apparatus according to the present invention may be provided in the form of a kit, elements of which are shown in FIG. 1. That is, the apparatus kit 100 includes an elongate bar 101 having hand grips 103 each disposed at opposite ends thereon and a neck support 105 disposed at a substantially central portion of the bar. The bar 101 may include at least one forearm plate 107 permanently or removably attached on an underside near either end of the bar 101. At least one resistance band 109 may be provided (although a plurality of resistance bands 117 and 119 are preferably provided in the kit form) for removable attachment of the forearm plate 107 with a foot brace 111. Such removable attachment advantageously facilitates e.g., changing of resistance bands to different levels of resistance/length, switching of the foot brace 111, as well as, e.g., in an embodiment including two forearm plates, switching between attachment of the resistance band 109 to either forearm plate. Accordingly, a user 201 may work both the right or left side muscle groups.

The bar 101 is preferably of a length suitable for comfortable arms-width gripping by an individual and may come in various lengths and/or include an adjustable feature (e.g., separate bars adjustably connected with insertable pins) for lengthening and/or shortening the length of the bar 101 as desired.

Preferably, the bar 101 is of a hollow cylindrical shape (e.g., with an interior diameter of approximately 0.5 inch and an exterior diameter of approximately 1.0 inch) and is comprised of a lightweight but substantially rigid material, e.g., aluminum, which may be treated (e.g., anodized) for additional wear-resistance.

The hand grips 103 may comprise e.g., a cushioning material that is affixed on each end of the bar 101. The cushioning material may comprise, e.g., rubber, foam, plastic, etc. or any other material which may improve comfort and/or frictional grip. Alternatively, the hand grips 103 may be integrally formed with the bar 101 and e.g., comprise a shape contoured for maximum comfort and security during gripping. In the exemplary embodiment shown in FIGS. 1 and 2, the grips 103 are aligned straight with the bar 101; however, alternate embodiments may be contemplated wherein the hand grips are provided at an angle to the bar 101, e.g., the grips are angled downwards relative to a bar 101 oriented in an 'in-use' position.

The neck support 105 may comprise a cushioned material or pad (e.g., comprised of rubber, foam, plastic, etc.) that may be affixed to or be integrally formed with the bar 101 and is preferably disposed at a substantially central portion of the bar. During use, the neck support 105 is preferably designed to provide contact with and support for the back of the user's neck, such as, e.g., to support the bar 101 at the point of leverage to lever the user 201. Ideally, the purpose of the neck support 105 is to facilitate a stable and comfortable relationship between the user 201 and the bar 101. In a preferred embodiment, the bar 101 includes angled portions 104 located adjacent to a substantially central portion of the bar 101 for holding the neck support 105 in a position offset from the bar 101 but wherein a length of the neck support 105 is substantially parallel to the bar 101 (as shown e.g., in FIG. 1) to, e.g., provide improved ergonomics.

Figure 3:
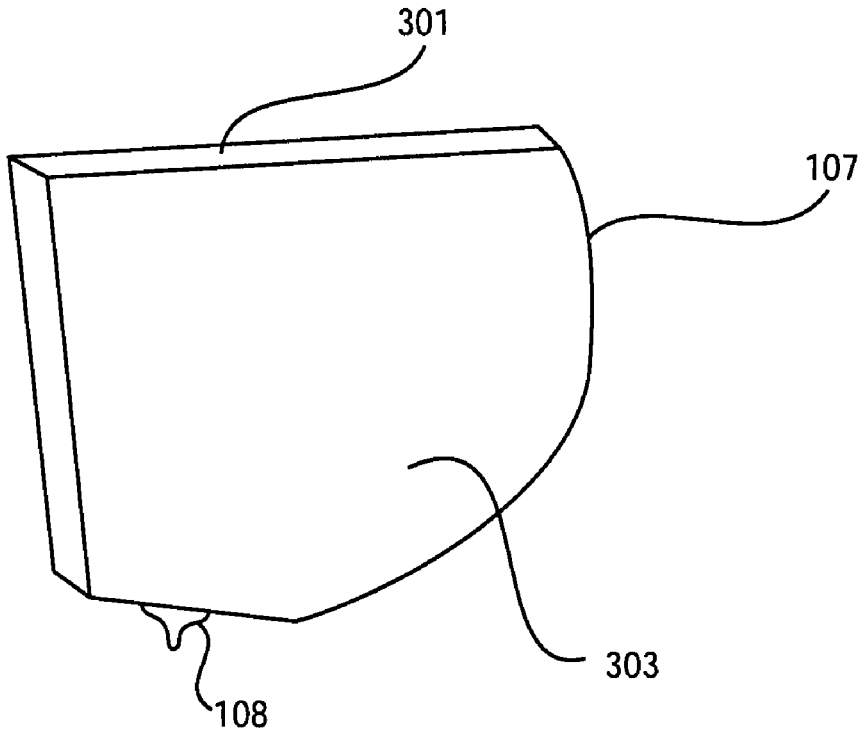
FIG. 3 is a front perspective view of a forearm plate according to an aspect of the present invention.

FIG. 3 is a front perspective view of a forearm plate according to an aspect of the present invention. The bar 101 includes at least one forearm plate 107 having an edge 301 permanently or removably attached along an underside near either end of the bar 101, preferably nearer to the handgrip 103 than the neck support 105 (e.g., as shown in FIG. 1). In a permanent embodiment, the plate 107 may be integrally formed with the bar 101 or otherwise permanently attached thereon. In a removable forearm plate embodiment, removable attachment of the forearm plate 107 to the bar 101 may be facilitated via any attachment means, e.g., clamps, screws, pins, etc.

The forearm plate 107 comprises a substantially flattened member having at least two faces 303; each face 303 may be flat or contoured to e.g., fit the shape of the forearm. The forearm plate 107 includes at least one point of attachment 108 at a substantially distal portion thereof for facilitating removable attachment of a resistance band 109 thereon to releasably connect the plate 107 with the foot brace 111. In one embodiment, the forearm attachment point 108 is disposed at an angle relative to the length of the bar (e.g., as shown in FIG. 1).

The plate 107 is preferably positioned and shaped to provide additional support and leverage for the user (e.g., by supporting a part of the user's arm) during use of the exercise apparatus 200. In one embodiment, during use of the apparatus 200 for e.g., practicing a golf swing, a user may position the back of his forearm against the forearm plate 107 (as shown in exemplary FIG. 2), e.g., so as to cause the back of the user's forearm to come into contact with a face 303 of the forearm plate 107 during, e.g., a backswing motion. The forearm plate 107 imparts resistive force on the user's arms when the user turns from a neutral position, thus, e.g., preventing all resistive force from being imposed only on the user's hand grip points during exercise. Advantageously, this assists in targeting specific muscle groups used, e.g., during a golf swing (e.g., bicep, deltoid and pectoral muscles) as well as preventing user fatigue at the hand grip points.

Alternatively, the user may be positioned in the apparatus 200 such that the front of the forearm is placed against the plate 107, e.g., so as to cause the front of the user's forearm to contact the forearm plate during, e.g., a downswing motion. In general, the plate 107 may assist with providing the user with additional leverage during, e.g., use of the apparatus 100 for overall upper body strength training.

The foot brace 111 comprises an elongate substantially rigid support platform 112 and a foot piece 113. In one embodiment, the platform 112 is 'universal' (designed for use with either the left or right foot) and preferably comprises a low profile support platform with a heel support which enables the user 201 to stand on the brace 111 with minimal change in the user's height while maintaining stability via heel support. The foot piece 113 comprises, e.g., a 'half-circle' shaped piece for additionally securing the foot to the platform 112.

At least one, but preferably two points of attachment 115 are provided at either end of the platform 112 to facilitate releasable attachment of one end of the resistance band 109 with one end of the bar, (e.g., for connection of one end of the foot brace 111 with the forearm plate 107).

Any number of a variety of resistance bands (e.g., 109, 117 and 119) may be provided of varying thicknesses and/or lengths to vary the level of resistance for the user. Such a variety of resistance bands may be enclosed in the kit form of the present invention. The resistance bands may be, e.g., color and/or number coded according to their various levels of resistance and may comprise any flexible, elastic and resilient material, for example, rubber, rubber composites, rubberized elastic, latex, or any other synthetic or natural elastic materials. The resistance band 109 includes attachment points 110 at each end thereof which facilitate removable attachment of a first end of the band 109 to the forearm plate 107, and a second end of the band 109 to one end of the foot brace 111. During use of the apparatus 200, the resistance band 109 may be extended/elongated under tension and contracted to its original state in a repetitive fashion.

Exemplary positioning of a user during use of the apparatus 200 to practice, e.g., a golf swing for hitting a ball to the right of the user is shown in FIG. 2. The user grasps each hand grip 103 in either hand and places the bar 101 behind his shoulders, with the neck pad 105 resting substantially on the back of his neck. In this embodiment, the user's left forearm is positioned such that the back of the user's left forearm is in contact with the forearm plate 107. The user places his left foot on the foot brace 111 to secure it down.

From this neutral position, the user twists and rotates his torso to the left (e.g., in a similar fashion as if he was performing a backswing of a golf club). The apparatus 200 provides resistance via the attached resistance band 109 which is elongated/twisted accordingly during the backswing motion; this utilizes and helps strengthen, e.g., the user's core muscle group. The user than proceeds with the downswing (twists and rotates to the right). Accordingly, the resistance of the resistance band 109 is released, which assists is guiding the user smoothly through the golf ball 'impact' zone and onto the follow-through position of the swing.

The present invention advantageously provides the ability for the user 201 to switch the attachment of the foot brace 111 (via resistance band 109) to either end of the bar 101, thus providing a workout for either a right or left swing action and accordingly exercising right or left side core muscle groups. Such ability is provided, e.g., via the points of attachments 208 and 215 of the assembled apparatus 200 (shown in FIG. 2) which themselves are facilitated by attachment points 108, 110 and 115 of the forearm plate 107, resistance band 109 and foot brace 111, respectively; in conjunction with the removable forearm plate embodiment (e.g., in which the plate 107 may be attached on either end of the bar 101), and/or an embodiment comprising a bar 101 having two plates 107 attached thereon.

It is to be noted that attachment points 108, 110 and 115 may comprise any releasable attachment means, e.g., ring and dee closures, clasps, wings and clamps, screws, male/female connection elements, etc.

Use of the present invention strengthens and lengthens the muscle action, providing increased stability and power to the golfer's swing, while enhancing muscle integrity. By grasping and placing the bar 101 around the shoulder and neck the present invention simulates positioning of the hands a relative distance from the body that closely resembles the relative distance from the body as the hands would typically be during a golf swing. Resistance is invoked during the swinging action via the elastic resistance bands, which flex around the body, thus similarly targeting the core muscles. In particular, the type of resistance provided by the present invention assists in isolating and strengthening core muscles utilized during all phases of the golf swing. The release motion provided by the present invention promotes improved balance and rhythm which is vital for clean golf ball striking. For example, use of lighter resistance bands can provide stretching and rhythm training benefits. Overall, the present invention provides exercise in balance with the primary core muscle groups while maintaining a proper golf spine angle. The present invention provides flexibility, convenience and portability as well as particular effectiveness as a golf swing training aid.

In addition, the present invention is beneficial to any user who desires to strengthen and tone core muscle groups. It may be utilized for any number of alternate exercises, e.g., involving bending/twisting, e.g., the user may rotate and hold either the backswing and/or follow-through motion, which causes a stretching primarily of the core muscle group.

Although the embodiment which incorporates the teachings of the present invention has been shown and described in detail herein, those skilled in the art can readily devise many other varied embodiments that still incorporate these teachings. Having described preferred embodiments for an exercise apparatus (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. An exercise apparatus comprising:

an elongate bar having a first end and a second end;

a handgrip disposed at each of the first and second end;

at least one forearm plate configured for contacting a user's forearm, the plate having an edge attached along an underside of the bar proximate to one of the first and second bar ends, the forearm plate including an attachment point;

a foot brace having at least one attachment point; and a resistance band having a first end attached to the forearm plate attachment point and a second end attached to the at least one foot brace attachment point.

2. The apparatus of claim 1, further comprising a neck support disposed at a substantially central portion of the bar.

3. The apparatus of claim 1, wherein the forearm plate is removably attached to the bar.

4. The apparatus of claim 1, wherein the resistance band is releasably connected to the forearm plate and the foot brace.

5. The apparatus of claim 2, wherein the bar includes angled portions for holding the neck support offset from the bar.

6. An exercise apparatus kit comprising:

an elongate bar having a first end and a second end;

a handgrip disposed at each of the first and second end;

at least one forearm plate configured for contacting a user's forearm, the plate having an edge attached along an underside of the bar proximate to one of the handgrips, the forearm plate including an attachment point;

at least one resistance band having a first end and a second end, each end including attachment points; and a foot brace having at least one attachment point.

7. The exercise apparatus kit of claim 6, further comprising a neck support disposed at a substantially central portion of the bar.

8. The exercise apparatus kit of claim 6, wherein the forearm plate is removably attached to the bar.

9. The exercise apparatus kit of claim 6, wherein the forearm plate is permanently attached to the bar.

10. The exercise apparatus kit of claim 6, further comprising a plurality of resistance bands, each having at least one of varying length and thickness.

11. The exercise apparatus kit of claim 6, further including two forearm plates attached to the bar at opposite ends thereon.

12. The exercise apparatus kit of claim 7, wherein the bar includes angled portions for holding the neck support offset from the bar.

13. An exercise apparatus comprising:

an elongate bar having a first end, a second end, two angled portions;

a handgrip disposed at each end of the bar;

a neck support disposed at a substantially central portion of the bar, wherein the angled portions hold the neck support offset from the bar;

at least one forearm plate configured for contacting a user's forearm, the plate having an edge attached along an underside of the bar proximate to one of the handgrips, the forearm plate including an attachment point at a substantially distal portion thereof;

a foot brace comprising a foot platform and a foot piece, the brace having at least one attachment point; and a resistance band having a first end releasably attached to the forearm plate attachment point and a second end releasably attached to the at least one foot brace attachment point.

14. The apparatus of claim 13, wherein the forearm plate is removably attached to the bar.

* * * * *